United States Patent [19]

Sergio

[11] Patent Number: 4,862,548

[45] Date of Patent: Sep. 5, 1989

[54] SCRAPING DEVICE FOR FLOOR AND SURFACE CLEANING MACHINES

[75] Inventor: Zoni Sergio, Parma, Italy

[73] Assignee: Dulevo S.p.A., Parma, Italy

[21] Appl. No.: 255,585

[22] Filed: Oct. 11, 1988

[30] Foreign Application Priority Data

Nov. 6, 1987 [IT] Italy ..... 22532 A/87

[51] Int. Cl.[4] ..... A47L 11/16

[52] U.S. Cl. ..... 15/49 R; 15/87; 51/177

[58] Field of Search ..... 15/87, 49 R, 50 R, 180; 51/174, 177

[56] References Cited

U.S. PATENT DOCUMENTS

| | | | |
|---|---|---|---|
| 2,668,968 | 2/1954 | Dobrowolski | 15/49 R |
| 4,097,950 | 4/1978 | Satterfield | 15/49 R |
| 4,150,456 | 4/1979 | Alvarez | 15/49 R |

*Primary Examiner*—Edward L. Roberts
*Attorney, Agent, or Firm*—Browdy and Neimark

[57] ABSTRACT

The invention relates to a scraping device for floor and surface cleaning machines, and comprises: a first upright bell-shaped element (2) fixed against rotation and having an edge (6a) adapted to bear directly on a surface to be cleaned, a second inverted bell-shaped element (9) engaged coaxially and rotatably inside the first element (2) to define a substantially closed chamber (10) therewith, spindles (13) rotatably through-penetrating the second element (9), scraping brushes (14having metal bristles and being engaged rotatively with the second element (9), outside the chamber (10), and rotatively rigid with the spindles, and drive members (15,16,17) for transmitting the rotary motion to the scraping brushes (14) engaging with the spindles (13) inside the chamber (10).

10 Claims, 2 Drawing Sheets

1
2
3
4
5
6
6a
7
8
9
9a
9b
10
10a
10b
11
12
13
13a
13b
14
15
16
19
20
21
22
23
24
24a
25
II
II

SCRAPING DEVICE FOR FLOOR AND SURFACE CLEANING MACHINES

BACKGROUND OF THE INVENTION

The invention has for its subject a scraping device for floor and surface cleaning machines.

As is known, floors and surfaces, whether located outdoors or indoors at industrial establishments, are scraped clean by means of purposely designed machines which only act on the ground through a scraping assembly, or alternatively, by means of sweeping machines mounting a scraping assembly on the front.

The last-named assembly is provided with metal bristles, and has the function of raising as by scraping dirt cakes stuck to the ground surface to leave debris which is subsequently picked up and taken away.

A scraping assembly usually includes several scraping brushes having specially hard bristles, generally made of steel, and a bell-shaped element facing the ground and adhering on the same which is effective to withhold the loosened dirt.

On scraping devices or assemblies of known design, said bell-shaped element has the following features: it carries the scraping brushes, is driven of rotary motion, and is held with its edges in contact with the ground.

As an example, this Applicant has already made a scraping assembly in which said bell-shaped element centrally supports three rotary brushes, and carries along its edges a skirt in direct contact with the ground to prevent scattering of the removed particles. The brushes are rotated by means of a belt extending between the brushes and the bell top.

Further, the bell is rotated about its center axis, thus imparting an orbital movement to the rotary brushes which, when combined with the rotary movement, improves the effectiveness thereof. However, the known scraping devices or assemblies have not been quite effective in all occasions, and the same exhibit some important deficiencies.

A first problem encountered has been the build-up of dirt and dust in the drive mechanism to the scraping brushes, which may result in fast deterioration of the efficiency of the same.

Another problem encountered is that the aforesaid bell-shaped element not always achieves close adhesion to the ground in the known types, and accordingly, an effective seal due to the scraping brush supporting function it is to serve.

In fact, a possible obstruction met across the floor by the brushes may result in the brushes being locally raised off the floor surface together with the bell-shaped element. In that case, a section of the bell-shaped element edge contacting the ground is apt to be raised and let out some of the scraped debris.

It has been pointed out already that the bell-shaped element is usually driven rotatively to also impart an orbiting movement to the scraping brushes, which is effective to improve their scraping action. This movement is, however, hindered and slowed down in part by the friction arising from the bell-shaped element contact with the ground.

It is also observed that the rotary motion of the bell causes rapid wear of the elastic skirt or strip or bristle array mounted at the bottom of the bell-shaped element in order to withhold the debris scraped off more positively within it.

SUMMARY OF THE INVENTION

This being the solution, the technical aim underlying this invention is to provide a scraping device for floor and surface cleaning machines which can obviate at least in part the cited problems.

Within this technical aim, it is an important object of this invention to provide a device which affords maximum scraping effectiveness of the brushes even in the presence of ground irregularities. Another important object of the invention is to provide a scraping device which can prevent dirt and loosened particles from getting into the drive mechanism to the scraping brushes.

A further object is to provide a scraping device which can withhold with the utmost effectiveness the debris scraped off by the brushes for a minimum of wear of the ground-contacting parts. The technical aim set forth and the objects specified are substantially achieved, according to the invention, by a scraping device for floor and surface cleaning machines being characterized in that it comprises, a first upright bell-shaped element having a substantially vertical axis, being fixed against rotation, and having an edge adapted to bear directly onto a surface to be cleaned, a second inverted bell-shaped element, coaxially and rotatably engaged with said first element, said second element being located within and juxtaposed to said first element, and defining a substantially closed chamber in cooperation with the same, spindles rotatably through-penetrating said second element, scraping brushes rotatively engaged with said second element, outside said chamber, and made rotatively rigid with said spindles, and drive members for transmitting the rotary motion to said scraping brushes, engaging said spindles inside said chamber.

BRIEF DESCRIPTION OF THE DRAWINGS

Further features and the advantages will be more closely understood from a description of a scraping device according to invention, shown in the accompanying drawings, where.

DESCRIPTION OF PREFERRED EMBODIMENTS OF THE INVENTION

Figure 1:
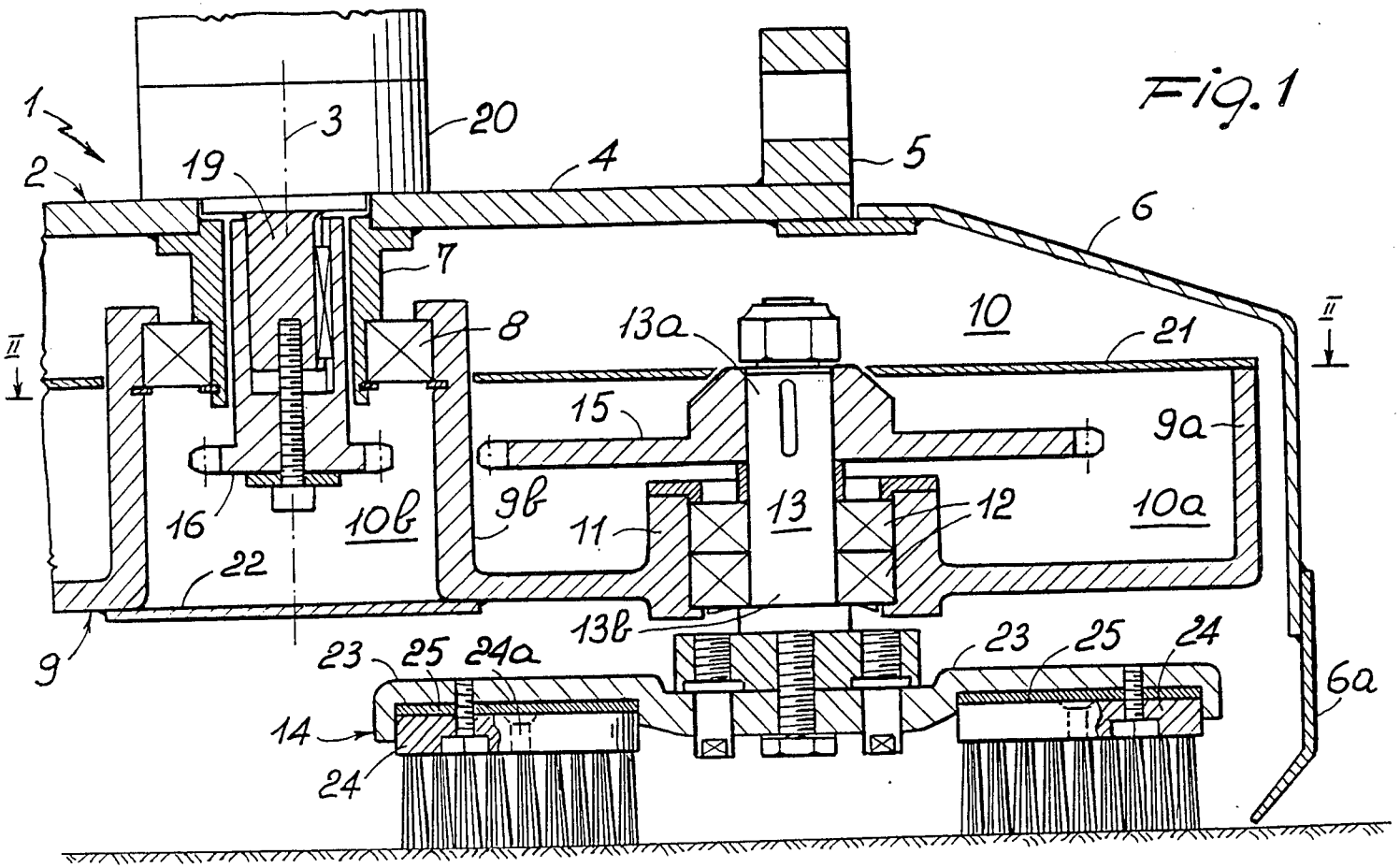
FIG. 1 is a sectional view taken on a vertical plane through the scraping device.

With reference to the drawing views, the scraping device is comprehensively designated 1.

It comprises a first upright bell-shaped element 2 having its concave side arranged to face the surface to be scraped and being defined by multiple portions rigidly interconnected by means of screws or welding and providing collectively a substantially symmetrical arrangement about a substantially vertical center axis 3 with the scraping device 1 in its working position.

The aforesaid multiple portions comprise a first central portion 4 defining the load-bearing structure of the scraping device 1 and having ears 5 for connecting the scraping device to a cleaning machine. Engaged with the first portion 4 is a second portion 6 defining the lateral part of the first bell-shaped element 2. The second portion 6 has at the bottom an edge *6a* adapted to bear on and rub against the floor to be cleaned and being formed of an elastic material strip or an array of bristles.

The first bell-shaped element 2 centrally comprises a hollow inside, substantially cylindrical enlargement 7 extending along the center axis 3 internally of the bell-shaped element. A first bearing 8, advantageously of the swivel rolling type, is associated with the enlargement 7 and engages externally with and supports a second inverted bell-shaped element 9, that is one having its concave side upwards, being located inside the first and defining a substantially closed protected chamber 10 therewith.

In the embodiment shown, the second element 9 is a box-type body which is engaged rotatively with the first bell-shaped element 2 and allowed to oscillate in planes substantially orthogonal to the surface to be cleaned.

It has a peripheral wall **9*a* and a central wall 9*b*, both ring-shaped. The peripheral wall 9*a*** may have a varying thickness to perform a flywheel function and impart considerable inertia to the second element even in the presence of a substantially reduced weight of the same.

The second inverted bell-shaped element 9, or box-type has, placed at equal distances from the center axis 3 and symmetrically spaced apart, three hubs 11 in which spindles 13 are articulated with the interposition of second bearings 12.

As brought out by FIG. 1, the spindles 13 through-penetrate the second element 9 and have a first end **13*a* inside the chamber 10 and a second end 13*b* outside it. Scraping brushes 14 engage with the second ends 13*b***.

Figure 2:
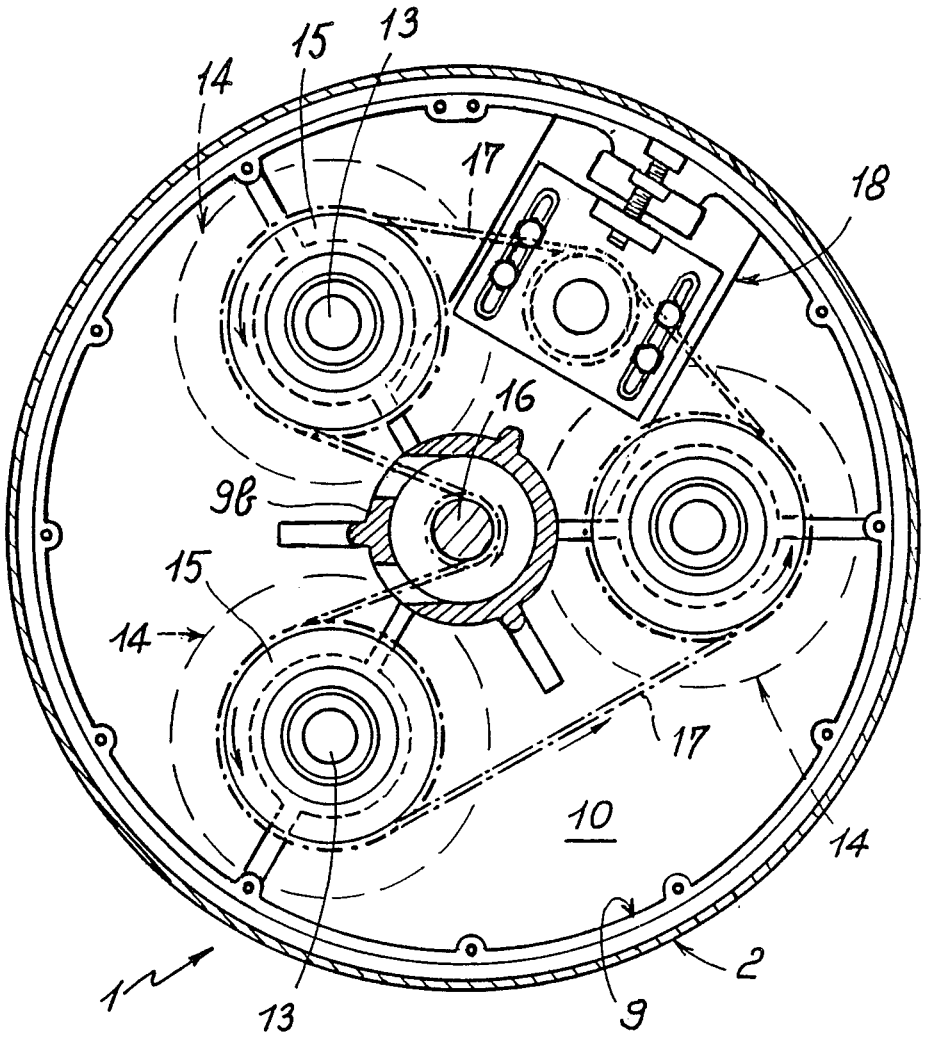
FIG. 2 is a part-sectional plan view of the invention device.

The rotary motion is transmitted to the first ends **13*a* of the spindles 13, and hence to the scraping brushes 14, via drive members which comprise sprocket wheels 15, each associated with one spindle 13, a driving sprocket pinion 16 provided at a central location in the second element or box-type body 9, and specifically placed inside the enlargement 7, and a drive chain 17 (FIG. 2) in mesh engagement with both the driving sprocket pinion 16 and the sprocket wheels 15**.

A tensioning assembly 18 contributes toward keeping the drive chain 17 under constant tension.

The driving sprocket pinion 16 is in turn engaged rotatively with an output shaft 19 of a motor 20, advantageously of the reversible hydraulic type, that is one which can turn in either directions of rotation.

It is advantageously arranged for a peripheral chamber **10*a* and central chamber 10*b* to be formed within the chamber 10 which are substantially sealed and laid side-by-side. These additional chambers are provided for improved protection of the members transmitting the rotary motion to the brushes 14**.

In fact, the second element or box-type body 9 is provided with a first annular cover 21 engaging a peripheral portion of the second element 9, located in particular between the peripheral wall **9*a* and the central wall 9*b* to form a peripheral chamber 10*a* accommodating the sprocket wheels 15, a major portion of the chain 17, and the tensioning assembly 18**.

A second cover 22 located centrally of the second element 9, on the central wall **9*b*, delimits the central chamber 10*b* and accommodates the driving sprocket pinion 16**.

The covers 21 and 22 also contribute toward strengthening the box-type body 9, which is therefore imparted considerable rigidity even in the presence of reduced thickness dimensions.

Each scraping brush 14 comprises a rotary holder 23 made preferably of a light alloy, and a pair of sheet-like elements. A first sheet-like element 24 divided into a pair of semicircular annuli formed preferably from plastics, engages in holes purposely provided with the steel bristles constituting the scraping members. The holes, indicated **24*a*, are of the through-going type, and the steel bristles are passed through the holes and bent above the first sheet-like element 24. A second sheet-like element 25 is then interposed to said first sheet-like element 24 and the load-bearing holder 23, and is formed from a material, such as steel, which can protect the load-bearing holder 23 against contact with the steel bristles of the scraping brush 14**, to avoid deteriorating it.

The operation of the device is as follows.

The scraping device 1 is caused to rub against the ground by the cleaning machine with which it is associated, and the scraping brushes 14 are driven both of a rotary motion about their axes and of an orbiting motion brought about by rotation of the second inverted bell-shaped element 9. The last-named motion derives spontaneously from the action itself of the drive chain 17, which acts tangentially of the brushes at points away from the axis 3, determining components of the applied loads which provide in combination a torque on the second element 9.

The rotation of the second element 9 is only resisted by the friction of the scraping brushes 14 across the ground, and significantly contributes toward improving the effectiveness of the scraping action. Where the floor to be scraped shows irregularities, the scraping brushes 14 can oscillate together with the box-type body or second element 9, inasmuch as the latter is engaged with a first bearing 8 of the swivel type.

The chain drive affords perfect holding of the drive without the chain being likely to jump out of its seats even in the presence of slight inclinations of the sprocket wheels 15. The debris loosened by the scraping brushes 14 are withheld by the edge **6*a* inwardly of the first upright bell-shaped element 2. Since the first element 2 does not rotate but just runs while rubbing against the ground, wear of the edge 6*a* is greatly reduced. Further, any localized obstruction met by the scraping brushes 14 will result in an oscillation of the second element or box-type body 9, leaving the first element 2** unaffected which can then retain unaltered its function of containment of the loosened debris, being induced to move upwards not even partially along its edge.

The drive members to the scraping brushes are protected against debris loosened by the scraping action in that they are enclosed within the chamber 10 and the peripheral chamber **10*a***. It follows that their wear will be minimal. Further, the protected position enables said drive members to be lubricated conveniently.

The use of a drive chain affords higher useful powers for scraping than belt drives, for example. The use of a reversible hydraulic motor enables execution of the scraping brush rotation in either possible directions of rotation, thus making for even wear of the bristles and increased life expectation therefor.

It should be also noted that the rotary movement of the second element or box-type body is particularly smooth also on account of the large inertia made available to it because, by virtue of the box-type construction, it can be suitably weightened at the peripheral wall in order to provide a flywheel effect which makes the scraping action of the brushes more effective and uniform.

I claim:

1. A scraping device for floor and surface cleaning machines, characterized in that it comprises: a first upright bell-shaped element (2) having a substantially vertical center axis (3), being fixed against rotation, and having an edge (6*a*) adapted to bear directly onto a surface to be cleaned, a second inverted bell-shaped element (9), coaxially and rotatably engaged with said first element (2), said second element (9) being located within and juxtaposed to said first element (2) and defining a substantially closed chamber (10) in cooperation with the said first element spindles (13) rotatably through-penetrating said second element (9), scraping brushes (14) rotatively engaged with said second element (9), outside said chamber (10), and made rotatively rigid with said spindles (13), and drive members (15,15,17) for transmitting rotary motion to said scraping brushes (14), engaging said spindles (13) inside said chamber (10).

2. A device according to claim 1, wherein a swivel bearing (8) is provided coaxially with said center axis (3) and engaged between said first upright bell-shaped element (2) and said second inverted bell-shaped element (9), said swivel bearing (8) supporting said second inverted bell-shaped element (9) such that said scraping brushes (14) can oscillate relatively to said first element (2).

3. A device according to claim 2, wherein said second element (9) comprises a peripheral wall (9*a*) and a central wall (9*b*) extending ring-like parallel to said center axis (3), said peripheral wall (9*a*) defining an outer edge of said second element (9), adjacent an inner wall of said first element (2), and said inner wall (9*b*) being engaged with said swivel bearing (8).

4. A device according to claim 1, wherein said drive members (15,16,17) are housed within said chamber (10) to protect them from dust and debris.

5. A device according to claim 1, wherein said drive members (15,16,17) comprise sprocket wheels (15) engaged with said spindles (13), a driving sprocket pinion (16) coaxial with said center axis (3), and a drive chain (17) stretched between said driving pinion sprocket (16) and said sprocket wheels (15).

6. A device according to claim 5, wherein a first annular cover (21) is arranged to engage with a peripheral portion of said second inverted bell-shaped element (9) and defining with said second element (9) a peripheral chamber (10*a*) inside said chamber (10), said sprocket wheels (15) and drive chain (17) being at least for a major portion inserted in said peripheral chamber (10*a*).

7. A device according to claim 5, wherein a second cover (22) is arranged to engage with a central portion of said second element (9) and defines with said second element (9) a central chamber (10*b*) inside said chamber (10), said driving sprocket pinion (16) being inside said central chamber (10*b*).

8. A device according to claim 1, wherein said second element (9) comprises a peripheral ring-shaped wall (9*a*) spaced apart and parallel to said center axis (3) and providing a flywheel for said second element (9).

9. A device according to claim 1, wherein a reversible hydraulic motor (20) is provided for driving said drive members (15,16,17), said reversible hydraulic motor (20) being supported on said first upright bell-shaped element (2).

10. A device according to claim 1, wherein each of said scraping brushes (14) comprises a light alloy load-bearing holder (23), at least a first sheet-like element (24) through-penetrated by metal bristles and affixed to said load-bearing holder (23), and a second metallic sheet-like element (25) arranged between said load-bearing holder (23) and said first sheet-like element (24) and adapted to provide said load-bearing holder (23) against contact with said bristles.

* * * * *

UNITED STATES PATENT AND TRADEMARK OFFICE

CERTIFICATE OF CORRECTION

PATENT NO. : 4,862,548

DATED : September 5, 1989

INVENTOR(S) : Sergio ZONI

It is certified that error appears in the above-identified patent and that said Letters Patent is hereby corrected as shown below:

On face of patent, please change Name of Inventor from "Zoni Sergio" to -- Sergio ZONI --.

Item [19], "Sergio" should be --ZONI--

Signed and Sealed this

Thirtieth Day of July, 1991

*Attest:*

HARRY F. MANBECK, JR.

*Attesting Officer*

*Commissioner of Patents and Trademarks*